US008385570B2

(12) United States Patent
Chiang et al.

(10) Patent No.: US 8,385,570 B2
(45) **Date of Patent: *Feb. 26, 2013**

(54) ELECTRET TRANSDUCER WITH SOLAR POWER AND AMPLIFIER CIRCUITRY

(75) Inventors: Dar-Ming Chiang, Hsinchu (TW); Shen-Long Liang, Hsinchu (TW); Shu-Ru Lin, Hsinchu (TW)

(73) Assignee: Taiwan Electrets Electronics Co., Inc., Hsinchu (TW)

( * ) Notice: Subject to any disclaimer, the term of this patent is extended or adjusted under 35 U.S.C. 154(b) by 0 days.

This patent is subject to a terminal disclaimer.

(21) Appl. No.: 13/553,413

(22) Filed: Jul. 19, 2012

(65) Prior Publication Data

US 2012/0281862 A1 Nov. 8, 2012

Related U.S. Application Data

(63) Continuation of application No. 12/794,432, filed on Jun. 4, 2010, now Pat. No. 8,300,860.

(30) Foreign Application Priority Data

Jun. 8, 2009 (TW) ..... 98119033 A

(51) Int. Cl.
*H04R 25/00* (2006.01)

(52) U.S. Cl. ..... 381/191

(58) Field of Classification Search ..... 381/191
See application file for complete search history.

(56) References Cited

U.S. PATENT DOCUMENTS 6,785,393 B2 * 8/2004 Lipponen et al. ..... 381/191
2003/0059068 A1 * 3/2003 Bank et al. ..... 381/152

* cited by examiner

*Primary Examiner* — Jeffrey Donels
(74) *Attorney, Agent, or Firm* — Morris Manning & Martin LLP; Tim Tingkang Xia, Esq.

(57) ABSTRACT

The present invention provides an electret transducer with solar power. The provided electrets transducer includes a solar power supply device, an amplifier circuit having a first input terminal coupled to the solar power supply device and a second input terminal coupled to an audio signal input terminal, and an electret loudspeaker coupled to an output terminal of the amplifier circuit. The amplifier circuit receives a first voltage level via the first input terminal and boosts the first voltage level to a second voltage level, and receives a first audio signal via the second input terminal and amplifies the first audio signal to a second audio signal. The electret loudspeaker coupled to the output terminal of the amplifier circuit receives the second audio signal and outputs a sound corresponding to the second audio signal.

19 Claims, 4 Drawing Sheets

ELECTRET TRANSDUCER WITH SOLAR POWER AND AMPLIFIER CIRCUITRY

CROSS-REFERENCE TO RELATED APPLICATIONS

This application is a continuation of, and claims benefit of U.S. patent application Ser. No. 12/794,432, filed Jun. 4, 2010, entitled "ELECTRET TRANSDUCER WITH SOLAR POWER", by Dar-Ming Chiang et al, which itself claims priority under 35 U.S.C. §119(a) on Patent Application No. 98119033 filed in Taiwan, R.O.C. Jun. 8, 2009, the entire contents of which are hereby incorporated by reference.

BACKGROUND OF THE INVENTION

1. Field of the Invention

The present invention relates to an electret transducer, and more particularly, to an electret transducer powered by solar energy.

2. Description of the Related Art

An electroacoustic loudspeaker is a transducer converting electric energy to sound energy. The transducers can be categorized into three types by the way in which they are driven. The three types of transducers are as follows: moving-coil transducer, piezoelectric transducer, and electrostatic transducer.

Currently, the moving-coil transducer is the most commonly used transducer and has been widely applied to products such as TVs, radios, earphones and cell phones. However, the development of the moving-coil transducer is limited by the inherent structure and the inflexible design in electric energy, thus, the moving-coil transducer is unable to meet the requirements of portable and low current-consuming electronic products. Additionally, the traditional electrostatic transducer requires a high DC bias (about 1500 volt to 2000 volt) amplifier which incurs high cost, thus it is not suitable for portable products. Therefore, a need exists in the art for an energy efficient, compact and transparent electroacoustic transducer with high reproduction quality.

Due to its flexible feature, the electret transducer is also called soft loudspeaker. The electret transducer features compact form, high efficiency, large bandwidth and less distortion and is of great potential to be applied in portable products when product volume and efficiency are taken into consideration.

In another aspect, when designing portable 3C products, one should pay as much attention to the source of the power supply as s/he does to the volume of the products. As shown in FIG. 1, in an amplifier circuit 10 of the traditional transducer, a DC power source 14 is supplied to an audio amplifier 12 to boost the voltage of an audio signal so as to vibrate a thin film of a loudspeaker 16 to generate a sound.

Presently, great efforts have been made by people from all walks of life to find an environmental friendly and sustainable electric energy source, thus, technologies using solar cells as power supply source are booming. Solar power is not only renewable, but also has the potential to be applied to portable products. Please refer to FIG. 2, it shows an amplifier circuit 20 of the traditional transducer in which a solar cell 24 is used as a DC power source to drive an audio amplifier 22. As the audio amplifier 22 of the traditional transducer requires high DC bias, it remains a need to integrate the solar cell 24 with a charging circuit and an energy-storage cell 25. The solar cell 24 charges the energy-storage cell 25 through the charging circuit so as to further provide power to the audio amplifier 22 to boost the voltage of an audio signal, thereby vibrating a thin film of a loudspeaker 26 to generate a sound.

As described above, the present systems using solar energy as power source need to be integrated with charging circuits and energy-storage cells to charge and store energy. Currently, there are no transducers operable without having to store electric energy.

SUMMARY OF THE INVENTION

The first aspect of the present invention is to provide a portable transducer being solely powered by a solar cell, which needs not to be integrated with a charging circuit and an energy-storage cell. Accordingly, the transducer is environmental friendly and highly applicable.

The second aspect of the present invention is to provide a low energy-consuming transducer having advantages of high electricity-saving efficiency and compactness, thus the low energy-consuming transducer is applicable to various portable or outdoor electronic products.

Based on above aspects, the present invention provides an electret transducer with solar power. The provided electret transducer includes a solar power supply device; an amplifier circuit having a first input terminal coupled to the solar power supply device and a second input terminal coupled to an audio signal input terminal, wherein the amplifier circuit receives a first voltage level via the first input terminal and steps up the first voltage level to a second voltage level, and wherein the amplifier circuit receives a first audio signal via the second input terminal and amplifies the first audio signal to a second audio signal; and an electret loudspeaker coupled to an output terminal of the amplifier circuit to receive the second audio signal and output a sound corresponding to the second audio signal.

Preferably, the solar power supply device is selected from one of a chip-typed solar cell, a thin-film solar cell and an organic solar cell.

Preferably, the solar power supply device is dimensioned from 20 mm×20 mm to 500 mm×500 mm.

Preferably, the solar power supply device provides a voltage level ranged from 0.03 volt to 20 volt.

Preferably, the solar power supply device provides a voltage level ranged from 2 volt to 10 volt.

Preferably, the first audio signal has a voltage value ranged from 50 mVAC to 2 VAC.

Preferably, the solar power supply device provides an alternating current value ranged from 10 mA to 200 mA.

Preferably, the amplifier circuit comprises one of a boost circuit to amplify and transfer the first voltage level to the second voltage level and an audio power amplifier to amplify and transfer the first audio signal to the second audio signal.

Preferably, the audio power amplifier is selected from one of a class A audio power amplifier, a class B audio power amplifier, a class C audio power amplifier, a class D audio power amplifier, a class AB audio power amplifier and an operational audio power amplifier.

Preferably, the audio power amplifier has a power value ranged from 0.2 W to 20 W.

Preferably, the amplifier circuit further comprises a transformer to adjust a voltage level of the second audio signal.

Preferably, the transformer has an impedance value ranged from 1Ω to 50Ω.

Preferably, the transformer has an input terminal having an inductance value ranged from 0.1 mH to 10 H.

Preferably, the transformer has an input terminal having an inductance value ranged from 0.1 mH to 100 mH.

Preferably, the transformer has an output terminal having an inductance value ranged from 1 H to 100 H.

Preferably, the transformer has a turn ratio ranged from 5 to 500.

Preferably, the transformer has a turn ratio of the transformer ranges from 5 to 200.

Preferably, the electret loudspeaker is selected from one of a flexible loudspeaker and a transparent loudspeaker.

Preferably, the electret loudspeaker has a capacitance value ranged from 30 pF to 30 nF.

Preferably, the electret transducer further includes an energy storage module coupled to the solar power supply device.

Based on the above aspects of the present invention, a low energy-consuming electret transducer transferring an inputted first audio signal to a second audio signal to be outputted is provided. The provided low energy-consuming electret transducer includes a low voltage power supply device providing a voltage level ranging from 0.03 volt to 20 volt; a transfer circuit having a first input terminal coupled to an audio signal input terminal to receive the first audio signal and a second input terminal coupled to the low voltage power supply device to receive therefrom a low voltage power, wherein the transfer circuit amplifies and transfers the first audio signal to the second audio signal; and an electret loudspeaker coupled to an output terminal of the transfer circuit to receive therefrom the second audio signal and output a sound corresponding to the second audio signal.

Preferably, the low voltage power supply device is a solar cell module.

Preferably, the transfer circuit comprises an audio power amplifier and a boost transformer coupled to each other to transfer the first audio signal to the second audio signal.

Advantages of the invention will be apparent from the following more particular description of preferred embodiments as illustrated in the accompanying drawings.

DETAILED DESCRIPTION OF THE PREFERRED EMBODIMENTS

While the present invention will be described in detail by way of preferred embodiments of the present invention with reference to the accompanying drawings, it is to be understood that the skilled person in the art can make various modifications to the present invention and achieve the same effect as disclosed herein. Hence, it is to be understood that the following description of the present invention is a broad interpretation to the skilled person in the art, and the present invention is not limited thereto.

Figure 1:
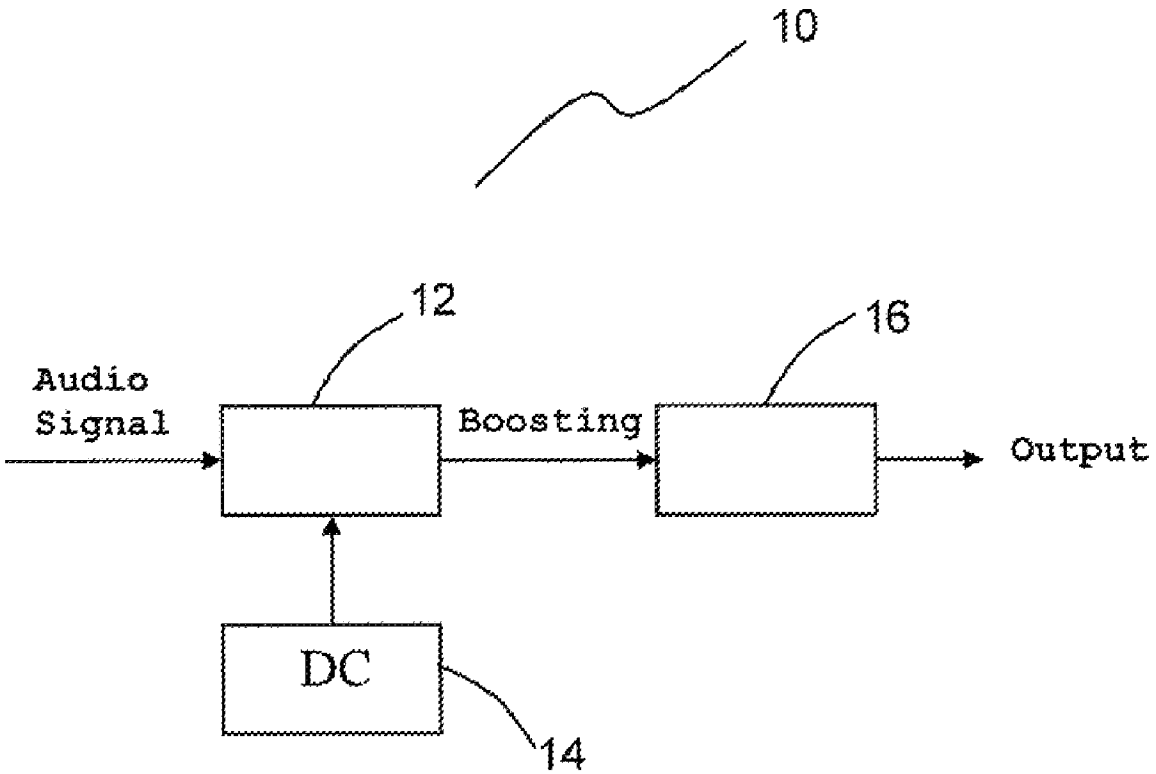
FIG. 1 (PRIOR ART)
FIG. 1 shows a block diagram of an amplifier circuit in a traditional transducer.
Figure 2:
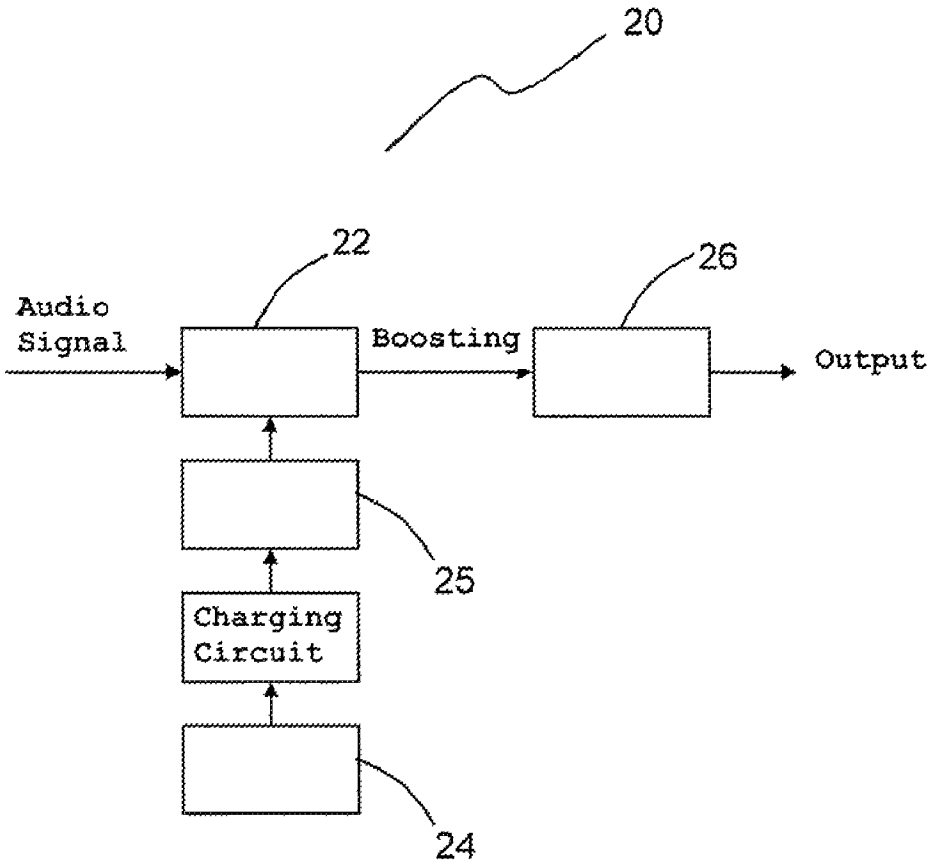
FIG. 2 (PRIOR ART)
FIG. 2 shows a block diagram of an amplifier circuit in another traditional transducer.
Figure 3:
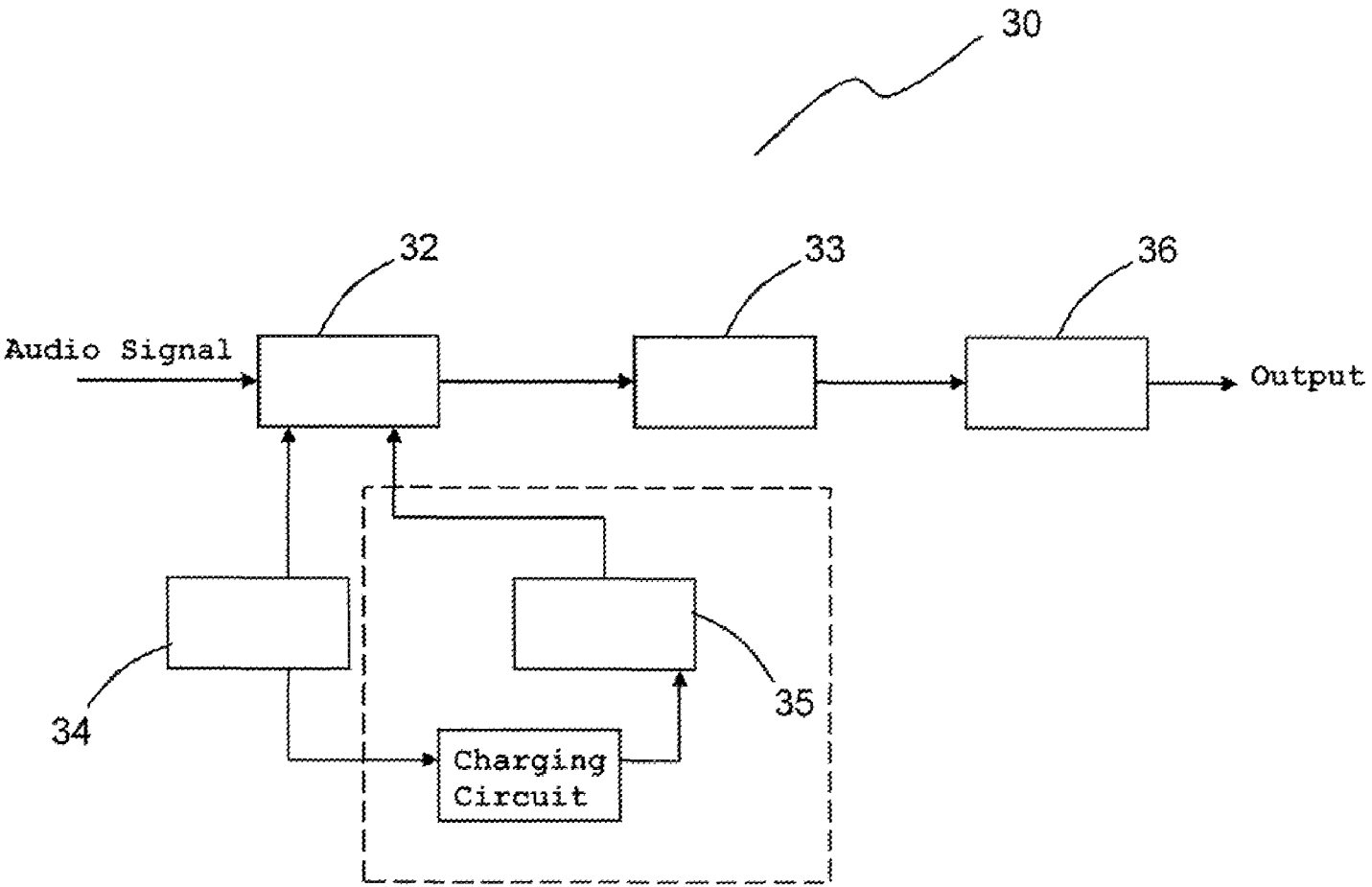
FIG. 3 shows a block diagram of an amplifier circuit of a low energy-consuming electret transducer in accordance with one embodiment of the present invention.

Please refer to FIG. 3, it shows a block diagram of an amplifier circuit of a low energy-consuming electret transducer in accordance with one embodiment of the present invention. In the present invention, the transducer is a device transferring electric energy to sound energy to be outputted—a so-called loudspeaker. A solar cell is used as the power supply device of the amplifier circuit in the low energy-consuming electret transducer of the present invention. As shown in FIG. 3, an amplifier circuit 30 comprises an audio amplifier 32, a boost transformer 33, a solar cell 34 and an electret loudspeaker 36.

A first input terminal of the audio amplifier 32 is coupled to the solar cell 34 to receive therefrom a first voltage level, and then the first voltage level is stepped up to a second voltage level by means of the boost transformer 33. A second input terminal of the audio amplifier 32 is coupled to an audio signal input terminal to receive a first audio signal, and then the first audio signal is amplified and transferred to a second audio signal, wherein the first audio signal is a sound signal having a voltage value ranging generally from 50 mVAC to 2 VAC.

An input terminal of the electret loudspeaker 36 coupled to the audio amplifier 32 via the boost transformer 33 receives the second audio signal, and then a sound responding to the second audio signal is generated.

In the present invention, the impendence value of the boost transformer 33 ranges from 1Ω to 50Ω. The inductance value of the input terminal of the boost transformer 33 ranges from 0.1 mH to 10 H (preferably, the inductance value of the input terminal of the boost transformer 33 ranges from 0.1 mH to 100 mH), and the inductance value of the output terminal of the boost transformer 33 ranges from 1 H to 100 H. In addition, the turn ratio of the boost transformer 33 ranges from 5 to 500, and preferably, the turn ratio of the boost transformer 33 ranges from 5 to 200.

As the low energy-consuming electret transducer of the present invention requires an electric energy of merely tens of milliamperes, the amplifier thereof can output a differential audio signal without a high DC bias to drive the internal electret film to vibrate in a push-pull type of action. In the present invention, the amount of the driving power required by the transducer depends on the dimensions of the loudspeaker. Take a 15 cm×15 cm loudspeaker for example, the transducer requires a driving power with a voltage value ranging from about 2V to 5V and a current value of about 30 mA, which is currently the driving limitation in integrated circuits. In order to meet the above requirements of the driving power, a wafer-based solar cell, a thin-film solar cell or an organic solar cell having dimensions ranging from 20 mm×20 mm to 500 mm×500 mm can be selected as the solar power supply device of the present invention. Such a solar power supply device can provide a voltage level ranging from 0.03V to 20V, even from 2V to 10V, and a current value ranging from 10 mA to 200 mA.

In the present invention, the amplifier circuit 30 can be selected from a class A audio power amplifier, a class B audio power amplifier, a class C audio power amplifier, a class D audio power amplifier, a class AB audio power amplifier and an operational audio power amplifier. The amplifier circuit 30 amplifies the first audio signal (sound signal) with a power value ranging from 0.2 W to 20 W and transfers the first audio signal to the second audio signal so as to make the electret loudspeaker generate a corresponding sound.

Based on the consideration of real applications, the electret loudspeaker 36 of the present invention is selected from one of a flexible loudspeaker and a transparent loudspeaker, and the capacitance value thereof ranges from 30 pF to 30 nF.

As for the currently commonly used solar cell modules, in real applications, a solar cell is integrated with a charging circuit and an energy-storage cell 35, which form an energy-storage module shown as a dotted frame in FIG. 3, to maintain a stable power supply. However, as the electret transducer of the present invention is characterized by a low energy consumption, the solar cell 34 alone can supply all the energy required by the transducer system without having to integrate with the energy-storage module as shown in the dotted frame in FIG. 3.

Figure 4:
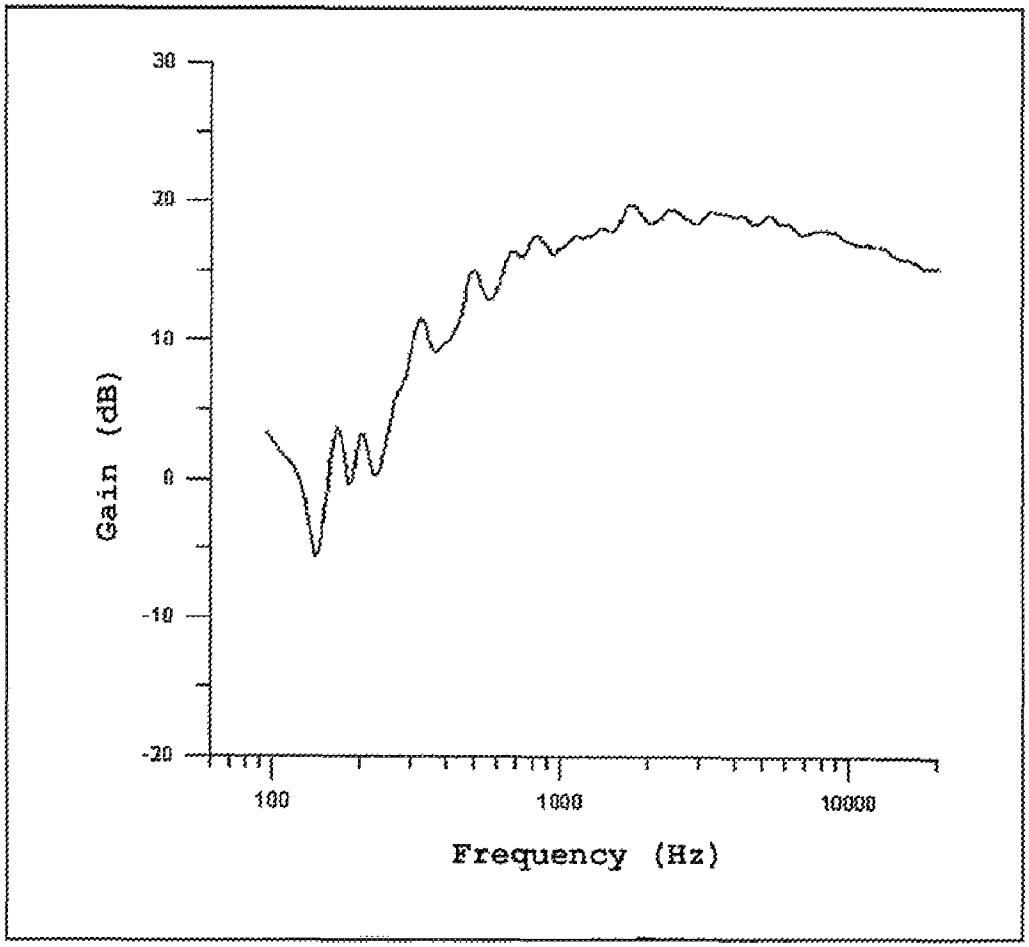
FIG. 4 shows the test results of the frequency response of an amplifier circuit of a low energy-consuming electret transducer in accordance with one embodiment of the present invention.

Please refer to FIG. 4, it shows the test results of the frequency response of an amplifier circuit of a low energy-consuming electret transducer in accordance with one embodiment of the present invention. Take the present electret transducer with solar power having 1 W power for example, it has a frequency of 1 KHZ, a capacitance value of 400 pF, a resistance value of 370 kΩ, and 1 W solar cell power that comprises no energy-storage module. According to the test results of the frequency response shown in FIG. 4, an output sound pressure level of the electret transducer is calculated and the sound pressure value is over 85 dB at a distance of 0.3 meter.

The present invention enables the transducer to maintain a compact form. Moreover, the use of solar power to generate electricity makes the transducer portable and operable without chemical energy-storage cells. Therefore, the present invention has advantages of high efficiency and less distortion and is applicable to portable or outdoor products. Thus the present invention has great potential application.

The present invention provides an environmental friendly and high value-added electret transducer with solar power which is operable without having to integrate with charging circuits and energy-storage cells.

Hence, the present invention is novel, inventive and industrially applicable and is worth further development. Various modifications and variations made within the spirit of the invention shall be considered as falling within the scope of the appended claims.

What is claimed is:

1. An electret transducer with solar power, comprising:

a solar power supply device;

an amplifier circuit having a first input terminal coupled to the solar power supply device and a second input terminal coupled to an audio signal input terminal, wherein the amplifier circuit receives a first voltage level via the first input terminal and steps up the first voltage level to a second voltage level, and wherein the amplifier circuit receives a first audio signal via the second input terminal and amplifies the first audio signal to a second audio signal; and an electret loudspeaker coupled to an output terminal of the amplifier circuit to receive the second audio signal and output a sound corresponding to the second audio signal, wherein the amplifier circuit comprises one of a boost circuit to amplify and transfer the first voltage level to the second voltage level and an audio power amplifier to amplify and transfer the first audio signal to the second audio signal.

2. The electret transducer with solar power of claim 1, wherein the solar power supply device is selected from one of a chip-typed solar cell, a thin-film solar cell and an organic solar cell.

3. The electret transducer with solar power of claim 1, wherein the solar power supply device is dimensioned from 20 mm×20 mm to 500 mm×500 mm.

4. The electret transducer with solar power of claim 1, wherein the solar power supply device provides a voltage level ranged from 0.03 volt to 20 volt.

5. The electret transducer with solar power of claim 1, wherein the solar power supply device provides a voltage level ranged from 2 volt to 10 volt.

6. The electret transducer with solar power of claim 1, wherein the first audio signal has a voltage value ranged from 50 mVAC to 2 VAC.

7. The electret transducer with solar power of claim 1, wherein the solar power supply device provides an alternating current value ranged from 10 mA to 200 mA.

8. The electret transducer with solar power of claim 1, wherein the audio power amplifier is selected from one of a class A audio power amplifier, a class B audio power amplifier, a class C audio power amplifier, a class D audio power amplifier, a class AB audio power amplifier and an operational audio power amplifier.

9. The electret transducer with solar power of claim 1, wherein the audio power amplifier has a power value ranged from 0.2 W to 20 W.

10. The electret transducer with solar power of claim 1, wherein the amplifier circuit further comprises a transformer to adjust a voltage level of the second audio signal.

11. The electret transducer with solar power of claim 10, wherein the transformer has an impedance value ranged from 1Ω to 50Ω.

12. The electret transducer with solar power of claim 10, wherein the transformer comprises an input terminal having an inductance value ranged from 0.1 mH to 10H.

13. The electret transducer with solar power of claim 10, wherein the transformer comprises an input terminal having an inductance value ranged from 0.1 mH to 100 mH.

14. The electret transducer with solar power of claim 10, wherein the transformer comprises an output terminal having an inductance value ranged from 1H to 100H.

15. The electret transducer with solar power of claim 10, wherein the transformer has a turn ratio ranged from 5 to 500.

16. The electret transducer with solar power of claim 10, wherein the transformer has a turn ratio of the transformer ranges from 5 to 200.

17. The electret transducer with solar power of claim 1, wherein the electret loudspeaker is selected from one of a flexible loudspeaker and a transparent loudspeaker.

18. The electret transducer with solar power of claim 1, wherein the electret loudspeaker has a capacitance value ranged from 30 pF to 30 nF.

19. The electret transducer with solar power of claim 1, further comprising an energy storage module coupled to the solar power supply device.

* * * * *